US005411303A

United States Patent [19]

To

[11] Patent Number: 5,411,303

[45] Date of Patent: May 2, 1995

[54] GUIDE RING FOR A DOOR KNOB ASSEMBLY

[75] Inventor: Derrick To, Vancouver, Canada

[73] Assignee: Masco Corporation of Indiana, Indianapolis, Ind.

[21] Appl. No.: 59,554

[22] Filed: May 10, 1993

[51] Int. Cl.[6] ..... E05B 15/02

[52] U.S. Cl. ..... 292/357; 292/DIG. 53

[58] Field of Search ..... 292/357, 348, DIG. 64, 292/DIG. 53

[56] References Cited

U.S. PATENT DOCUMENTS

| | | | |
|---|---|---|---|
| 3,716,261 | 2/1973 | Gerlach | 292/357 X |
| 5,118,152 | 6/1992 | Lin | 292/357 X |
| 5,190,327 | 3/1993 | Lin | 292/357 X |

*Primary Examiner*—Philip C. Kannan

*Attorney, Agent, or Firm*—Malcolm L. Sutherland; Leon E. Redman

[57] ABSTRACT

In a door knob assembly, a guide ring for a door fits within a rose member and provides a locator so the rose member is located exactly in the center of the round opening through the door, and provides additional strength to prevent movement of the door knob assembly in the door. The guide ring has guide tubes thereon that align with holes in the inside rose member. The guide tubes ensure that attachment screws to be threadably received in tapped holes in posts of the outside rose member are inserted axially parallel to both the axis of rotation of the door knob assembly and the posts. The guide ring ensures that the screws line up with tapped holes in posts of the outside rose member and do not float or drift out of such alignment.

6 Claims, 1 Drawing Sheet

FIG. 1.
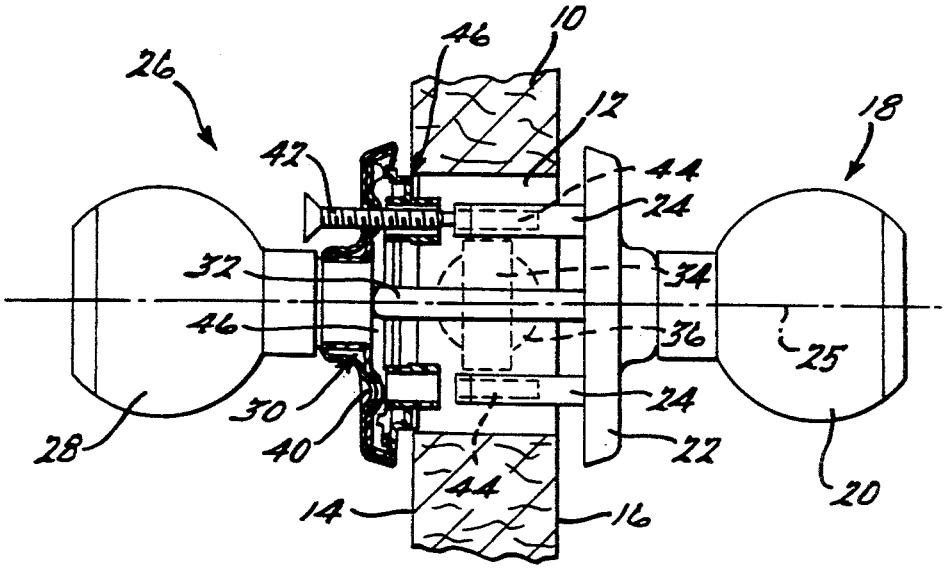
FIG. 2.
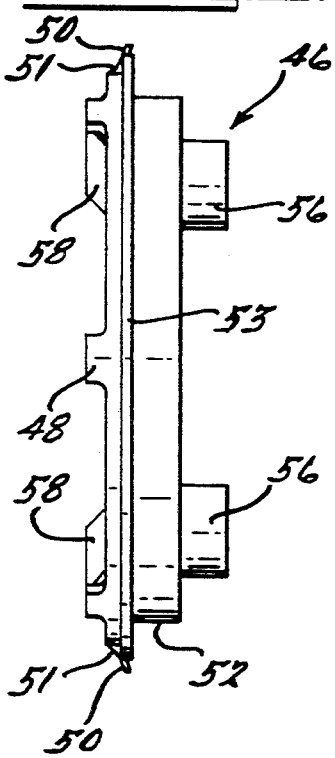
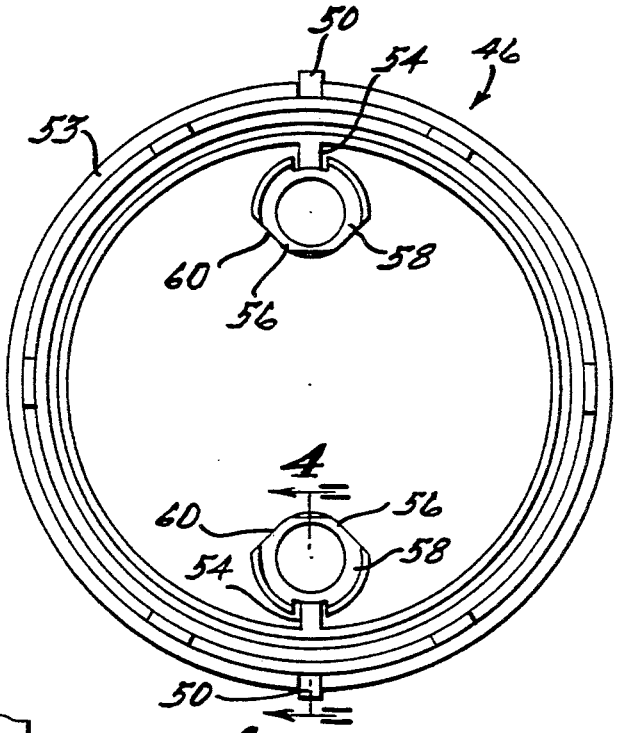
FIG. 3.
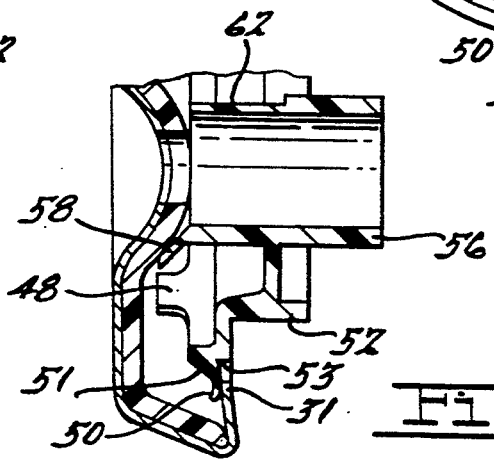
FIG. 4.

GUIDE RING FOR A DOOR KNOB ASSEMBLY

TECHNICAL FIELD

The present invention relates to a door knob assembly and more specifically to a guide ring to fit within an assembly for ease of installation and to provide additional strength to the whole assembly.

BACKGROUND OF THE INVENTION

A latch assembly for a door has an outside door knob member that attaches to the outside face of a door, and an inside door knob member that attaches to the inside face of the door. The members are connected through an opening in the door. A bore extends from a side edge of the door transversely into the opening and the latch mechanism fits within this bore. Thus, when the unit is assembled door knob members mounted on both faces of the door are connected to a latch mechanism within the door with the latch extending from a side edge of the door. Most common latch assemblies have an outside knob assembly which comprises a knob member joined to a shank rotatable within a rose member. The rose member fits over the opening in the door and has two internally threaded posts that extend into the opening. On the inside face of the door is an inside knob assembly which has a door knob member and a rose member. Countersunk holes are generally provided in the rose member to receive flat head screws used to attach the inside rose member to the internally threaded posts of the outside rose member.

Clearance is provided in the opening in the door to allow some vertical movement of the door knob assemblies before the two rose members are clamped together with the machine screws in the threaded holes of the two posts. The flat head screws are inserted through the holes in the inside rose member and then must be precisely aligned with the threaded holes in the posts of the outside rose member. The inside rose covers the opening in the door obscuring a view of the screw receiving opening of the threaded posts which are spaced away from the openings in the inside rose. This results in some difficulty when assembling the inside knob assembly to the outside knob assembly as the long screws must be blindly inserted through the openings in the inside rose and precisely aligned with the opening of the internally threaded posts and rotated to threadingly engage the threaded posts. This can become difficult, tedious and time consuming.

SUMMARY OF THE INVENTION

It is a primary object of the present invention to facilitate the insertion of mounting screws through an inside rose member of a door latch assembly for threaded engagement with internally threaded posts on an outside rose member of the assembly.

It is a further object of the present invention to provide a guide member for a door latch assembly, the guide member engaging both the inside rose member and the opening in the door so that the inside rose member is located exactly in the center of a round opening through the door to further facilitate assembly of the door latch assembly to the door.

According to the present invention, the guide ring has guide tubes thereon aligned with the threaded holes in the inside rose member. These guide tubes ensure that the flat head screws line up with the threaded holes in the posts of the outside rose member. The guide tubes ensure that the attachment screws are inserted axially parallel to the axis of rotation of the door knob assembly and the screw ends are not able to float or drift out of alignment with the threaded posts of the outside rose member.

More particularly, the present invention is employed in a door latch assembly for a door which has an opening between an inside face and an outside face, the door having a bore extending from a side edge transversely into the opening, an outside rose member for the outside face of the door with an outside knob member rotatably mounted thereon, the outside rose member having two internally threaded posts extending into the opening, an inside rose member for the inside face of the door with an inside knob member rotatably mounted thereon, the inside rose member having holes therein for alignment with the two posts on the outside rose member, with screws to be inserted through the holes in the inside rose member to threadably engage the posts on the outside rose member to clamp the rose member on the door. The knob members have a common axis of rotation with a spindle piece disposed at the axis for rotatably connecting the two knob members. A latch bolt assembly in the bore is connected to the spindle piece so that rotation of at least one of the knob members operates the latch bolt assembly. The present invention provides an assembly guide ring for installing the door latch assembly. The guide ring fits within the inside rose member with the guide ring having retaining means for retaining guide ring in place, the guide ring further having an engagement shoulder to align the inside rose member in the opening of the door, and protruding guide means on the guide ring to guide the screws inserted through the two holes in the inside rose member for threaded engagement with the two internally threaded posts on the outside rose member during installation of the door latch assembly.

These and other objects, features and advantages of the invention will become more apparent and more fully understood by reference to the following detailed description of a preferred embodiment, especially when read in conjunction with the accompanying drawing wherein:

BRIEF DESCRIPTION OF THE DRAWING

FIG. 1 is a partial sectional view showing a door knob assembly with an assembly guide ring according to one embodiment of the present invention;

FIG. 2 is a side view of one embodiment of an assembly guide ring;

FIG. 3 is plan view of the assembly guide ring shown in FIG. 2; and

FIG. 4 is an enlarged fragmentary sectional view showing in greater detail the connection between the guide ring and the inside rose member.

DETAILED DESCRIPTION OF THE PREFERRED EMBODIMENT

A door latch assembly is shown in FIG. 1 wherein a door 10 has an opening 12, generally a round or circular opening, extending from an inside door face 14 to an outside door face 16. An outside door knob assembly 18 has a knob member 20 rotatably mounted on an outside rose member 22. The outside rose member 22 has two attached or integral posts 24 which extend into the opening 12 and are parallel to an axis 25 of rotation of the knob member 20. An inside door knob assembly 26 has a knob member 28 rotatably mounted on an inside rose member 30. A spindle piece 32 extends between the inside knob assembly 26 and the outside knob assembly 18 on the axis 25 and is connected at its center to a latch bolt assembly 34 which has a bolt extending through a bore 36 to a side edge (not shown) of the door 10. The mechanism of the latch bolt assembly 34 is not shown in detail but is of the type well known in the art.

The inside rose member 30 shown in Section in FIG. 1 has countersunk holes 40 therethrough for flat head screws 42 to be inserted. The holes 40 are aligned to the posts 24 of the outside rose member 22. These outside posts have tapped or threaded holes 44 at their ends into which the screws 42 are threadably received. The screws 42 are initially inserted into the holes 40 of the inside rose member 30 at an angle to avoid interference with the knob member 28.

The assembly guide ring 46 is shown in more detail in FIGS. 2 and 3. The ring 46 is molded of plastic and designed to fit within the inner rose member 30. A number of tabs 48 protrude inward from the ring 46 to either abut or be slightly spaced from the inside surface of the inside rose member 30. The spaces between the tabs 48 provide clearance for a rose member which may have a noncircular multi-faceted cross-sectional configuration. Two snap clips 50 disposed 180° apart, extend radially outward from the edge of the ring 46 to engage in an inner lip 31 of the rose member 30 and hold the ring 46 to the inner rose member 30 as shown in FIG. 4. Ramp 51 on snap clip 50 facilitates snapping the clip 50 over the edge of the inner lip 31. The ring 46 has a shoulder 52 on the opposite face from the tabs 48, the shoulder having a circular configuration diameter for a location fit in the opening 12 in the door 10. The circular rim 53 of the ring 46 has a diameter slightly less than the inside diameter of the inner lip 31. Different sizes of rings may be made to suit the design of different rose members 30 and also to suit the diameter of opening 12 in door 10.

Attached by a plastic strip 54 to the inside of ring 46 are two tubes 56 which have a lead in flange 58 on the face directed toward rose member 30. The lead in flange 58 may be provided with cutout sections 60 for clearance with any internal mechanism such as a locking bridge (not shown) on the interior of the inside rose member 30. The tubes 56 are disposed parallel to each other and at a 90° angle to the rim 53. The inside diameter of the tubes 56 are designed for an easy fit of machine screws 42 and are aligned to match holes 40 in the inside rose member 30. The outer cylindrical wall of tubes 56 may likewise be provided with cutout sections 62 for clearance of internal mechanisms.

In operation, tubes 56 of ring 46 are aligned with holes 40 in the inside rose member 30. Ring 46 is then easily clipped by means of snap clips 50 into the inside rose member 30. Screws 46 are inserted through holes 40 and tubes 56. For installation, the outside knob assembly 18 is put in place first. The inside knob assembly 26, with the guide ring 46 screwed in place on the inside of the inside rose member 30, is then aligned with the outside knob assembly 18 and put in place on the inside face of the door. For doors less than one and a half inches thick, the screws 42 are inserted prior to alignment with the outside knob assembly 18. For doors having a thickness greater than one and a half inches, the screws 42 may be installed after the inside knob assembly has been put in place.

Screws 42 are tightened and the alignment shoulder 52 provides a strong connection between the inside knob assembly 26 and opening 12 in the door 10. The position of the assembly does not rely only on the clamping action between the rose members 22, 30 and door 16, but also on the alignment shoulder 52. Thus a vertical or side load on the knob does not move the door knob assembly 26 relative to the door 16.

Various changes may be made to the assembly guide ring shown herein without departing from the scope of the present invention which is limited only by the following claims.

What is claimed is:

1. In a door latch assembly for a door which has an opening between an inside face and an outside face, the door having a bore extending from a side edge transversely into the opening;

an outside rose member for the outside face of the door with an outside knob member rotatably retained thereto, the outside rose member having two posts extending into the opening;

an inside rose member for the inside face of the door with an inside knob member rotatably mounted thereon, the inside rose member having holes therein for alignment with the two posts on the outside rose member;

fasteners for extending through the holes in the inside rose member to engage the posts on the outside rose member to clamp the rose members to the door;

the knob members having a common axis of rotation with a spindle piece at the axis rotatably connecting the two knob members, and a latch bolt assembly in the bore having connection to the spindle piece so that rotation of at least one of the knob members operates the latch bolt assembly;

the improvement comprising:

a guide ring adapted to fit within the inside rose member, said guide ring having retaining means for connecting the guide ring to said inside rose member, the guide ring having an engagement shoulder to position the inside rose member substantially in the center of the opening of the door; and protruding guide means on the guide ring to guide the fasteners extending through the two holes in the inside rose member toward engagement with the two posts on the outside rose member during installation of the door latch assembly to the door.

2. The door latch assembly according to claim 1 wherein said two posts are provided with tapped holes concentric with each of the two posts and the fasteners comprising flat head screws to extend through holes in the inside rose member to be threadably received in the tapped holes of the two posts.

3. The door latch assembly according to claim 1 wherein the assembly guide ring is formed from plastic material.

4. The door latch assembly according to claim 1 wherein the retaining means for connecting the guide ring to the inside rose member comprises snap clips adapted to retain the guide ring in place relative to said inside rose member.

5. The door latch assembly according to claim 1 wherein the protruding guide means of the guide ring are tubular in shape and flared at an end adjacent to the holes in the inside rose member.

6. The door latch assembly according to claim 1 wherein the engagement shoulder of the guide ring fits into the opening of the door to strengthen the connection of the door latch assembly when installed in a door.

* * * * *